US005141328A

United States Patent [19]

Dilley

[11] Patent Number: 5,141,328

[45] Date of Patent: Aug. 25, 1992

[54] HIGH SPEED MIXING APPARATUS

[76] Inventor: Jerry D. Dilley, Rte. 3, Box 420, Granbury, Tex. 76048

[21] Appl. No.: 735,712

[22] Filed: Jul. 26, 1991

Related U.S. Application Data

[63] Continuation of Ser. No. 527,578, May 23, 1990, abandoned.

[51] Int. Cl.[5] ..... B01F 7/28

[52] U.S. Cl. ..... 366/305; 165/92; 165/109.1; 366/147; 366/149; 366/307; 416/236 R

[58] Field of Search ..... 241/260, 261, 261.3, 241/242, 291

[56] References Cited

U.S. PATENT DOCUMENTS

| | | | |
|---|---|---|---|
| 2,103,102 | 12/1937 | Thoresen | 165/109.1 X |
| 2,474,006 | 6/1949 | Maycock . | |
| 2,474,007 | 6/1949 | Maycock . | |
| 2,969,960 | 1/1961 | Gurley, Jr. . | |
| 2,970,817 | 2/1961 | Gurley, Jr. . | |
| 3,333,828 | 8/1967 | Boehme . | |
| 3,438,742 | 4/1969 | Grunewald et al. | 165/92 X |
| 3,438,744 | 4/1969 | Steijner | 165/92 X |
| 3,471,131 | 10/1969 | Fritzweiler et al. . | |
| 3,650,319 | 3/1972 | Boon | 366/307 X |
| 3,684,732 | 8/1972 | Grabauskas . | |
| 3,774,887 | 11/1973 | Dunn | 366/98 X |
| 4,087,863 | 5/1978 | Erdmenger et al. . | |
| 4,128,342 | 12/1978 | Renk . | |
| 4,599,208 | 7/1986 | Blaak | 366/302 X |
| 4,887,907 | 12/1989 | Hahn et al. | 366/147 X |

FOREIGN PATENT DOCUMENTS

| | | | |
|---|---|---|---|
| 148095 | 2/1904 | Fed. Rep. of Germany | 241/291 |
| 1215358 | 4/1960 | France | 366/305 |
| 2282548 | 3/1976 | France | 416/236 R |
| 4998 | 8/1893 | Switzerland | 241/260 |
| 22121 | 10/1906 | United Kingdom | 416/235 |
| 1390190 | 4/1975 | United Kingdom | 366/303 |

*Primary Examiner*—Harvey C. Hornsby
*Assistant Examiner*—C. Cooley
*Attorney, Agent, or Firm*—James E. Bradley

[57] ABSTRACT

A high speed mixing apparatus is shown for slurry materials which includes a stationary housing and a cylindrical rotor mounted for rotation within the housing. The rotor has an outer surface which is embossed with a repeating pattern of pyramidal shapes, each pyramidal shape having four triangular faces which meet at an apex. Each face has a base edge which forms grooves in the rotor for directing the flow of slurry in directions 45 degrees relative to the rotor's axis of rotation.

10 Claims, 3 Drawing Sheets

133
143
135
137
139
208
205
206
210
117
202
123
127
155
204
119
125
200
115
212
222
220
216
151
218
214

HIGH SPEED MIXING APPARATUS

This application is a continuation of application Ser. No. 527,578, filed May 23, 1990, now abandoned.

BACKGROUND OF THE INVENTION

1. Field of the Invention

The present invention relates to a device for the high speed mixing of a plurality of materials and specifically to a high speed mixing device for uniformly dispersing solids within a viscous liquid slurry to produce a homogeneous product.

2. Description of the Prior Art

A large variety of manufacturing processes call for the uniform dispersion of dissimilar materials to produce a homogeneous slurry product. Often, the starting materials are lumpy, high viscosity fluid mixtures of materials such as paint formulations, inks adhesive compositions, natural and synthetic latices, and the like. In the case of many paint formulations, a pigment is supplied as a very fine powder which must be uniformly dispersed within a viscous resin/solvent carrier to produce a master batch. The master batch is then tinted to produce the desired paint color.

Certain of the prior art devices have utilized sand, grit, shot or ceramic balls within the slurry as it passed through the mixing device to achieve a more uniform mixture. However, these added media have tended to produce accelerated wear on the equipment due to their abrasive nature. Also, in order to use such added media, the liquid carrier was required to be relatively thin, making the technique unsuitable for highly viscous slurries.

Various prior art mixing devices are known with cone-shaped rotor or stator parts. However, the continuous increase of the mass acceleration in the direction of the converging passage can result in uneven mixing intensity.

Other devices are known which feature concentric cylinder rotor and stator parts. In certain of the prior art devices, the rotor inside the cylindrical housing is provided with axially intermittent cylindrical sections having a diameter smaller than the diameter of the housing. In other sections, the rotor outside diameter is substantially equal to the inside diameter of the housing, thereby subjecting the slurry product to multiple interruptions. Multiple edge mixers are also known in the prior art.

None of the prior art devices, to my knowledge, have been successful in producing a uniform dispersion of a highly viscous, lumpy slurry of the type encountered with paints, lacquers, inks and plastics.

The present invention has as its object to provide a mixing apparatus for producing a uniform dispersion from lumpy, highly viscous slurries without the addition of solid media such as sand, grit, shot or ceramic balls.

Another object of the invention is to provide a concentric cylinder rotating mixer having a cylindrical rotor which has an improved useful life span, even when mixing solid particulate materials with viscous and tacky slurries.

Another object of the invention is to provide an apparatus which will uniformly disperse dry paint pigment in a resin/solvent carrier to produce a continuous, homogeneous product.

SUMMARY OF THE INVENTION

The high speed mixing apparatus of the invention includes a stationary housing having cylindrical interior sidewalls, an inlet and an outlet. A central bore extends through the housing and communicates with the inlet and outlet. A rotor means, preferably a cylindrical drum, is mounted within the central bore for rotation with respect to the stationary housing. The drum is spaced-apart from the housing interior sidewalls to define a sleeve-like space for the passage of slurry materials between the inlet and outlet. The drum has an outer surface which is embossed with a repeating pattern, of pyramidal shapes. Each pyramidal shape has four triangular lateral faces which meet at an apex which protrudes generally perpendicular from the outer surface. The pyramidal shapes are oriented 45 degrees to the axis of rotation of the drum. Propulsion means, such as a motor having an output shaft, is coupled to the drum for rotating the drum within the central bore.

Preferably, a portion of the interior sidewalls of the stationary housing are also provided with an embossed surface. Suitable passage means are preferably provided whereby coolant/lubricant can also be circulated through the interior of the cylindrical drum to provide temperature control.

Additional objects, features and advantages will be apparent in the written description which follows.

BRIEF DESCRIPTION OF THE DRAWINGS

in FIG. 3.

DETAILED DESCRIPTION OF THE INVENTION

Figure 1:
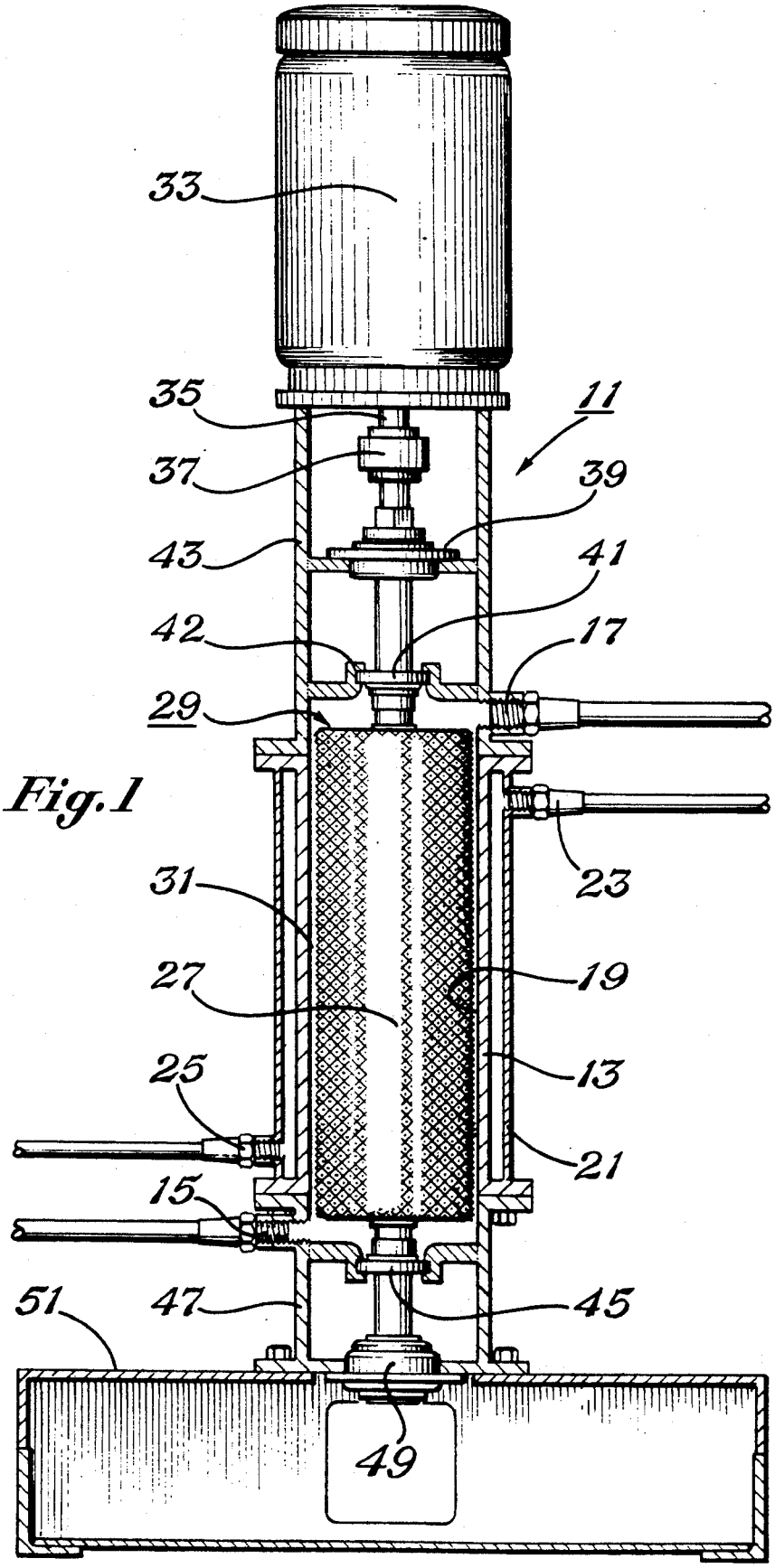
FIG. 1 is a side view of the mixing apparatus of the invention with portions of the housing and base shown in cross-section to better illustrate the internal workings of the apparatus.

FIG. 1 shows a high speed mixing apparatus of the invention designated generally as 11. The mixing apparatus includes a stationary housing 13 having a slurry inlet 15 and a slurry outlet 17. The housing has interior sidewalls 19 which define a vertically oriented, central bore which communicates the inlet and outlet. In the embodiment of the invention shown in FIG. 1, the interior sidewalls 19 are smooth. However, as will be discussed subsequently, depending upon the application, the interior sidewalls 19 can be roughened or textured. An outer concentric jacket 21 surrounds the housing 13 and is provided with a coolant inlet 23 and a coolant outlet 25.

A rotor means, such as a stainless steel cylindrical drum 27, is mounted within the central bore 29 for rotation with respect to the stationary housing 13. The drum 27 and housing 13 comprise a concentric cylinder mixing arrangement with the drum being spaced from the housing interior sidewalls 19 to define a sleeve-like space 31 for the passage of slurry materials between the inlet 15 and the outlet 17. The drum 27 extends substantially the full length of the central bore 29 between the inlet 15 and the outlet 17.

Propulsion means, such as electric motor 33 are provided for rotating the drum 27 within the central bore 29. A number of commercially available electric or hydraulic motors can be utilized depending upon the drum length and diameter. Preferably, the motor is effective to produce a rotational speed in the range from about 1,800 to 3,600 revolutions per minute, even with a slurry having a viscosity on the order of 110,000 centipoise. The flow rate through the apparatus is preferably about 0.5 g.p.m. to 1.50 g.p.m.

A typical paint master batch, of the type mixed with the apparatus of the invention will have about 40 to 60% by volume dry pigment in a liquid resin/solvent carrier. The pigment will have been mixed with the resin/solvent in a paddle mixer and then pumped to the slurry inlet 15 as a viscous, lumpy slurry having a viscosity ranging up to about 110,000 centipoise.

As shown in FIG. 1, the motor output shaft 35 is connected by a conventional shaft coupling 37, bearing assembly 39 and shaft seal 41 to the cylindrical drum 27 for rotating the drum. Shaft seal 41 rotates within the seal housing 42 is preferably a disk-shaped element having a wear face formed of solid tungsten carbide However, other seal configurations will be apparent to those skilled in the art. The shaft seal 41 also isolates the stationary housing 13 from the upper housing extension 43 containing the motor and drive components of the apparatus. In similar fashion, a lower shaft seal 45 isolates the bore 29 from lower housing portion 47 which contains a lower bearing 49 and which joins a horizontally extending base or support 51.

Figure 2:
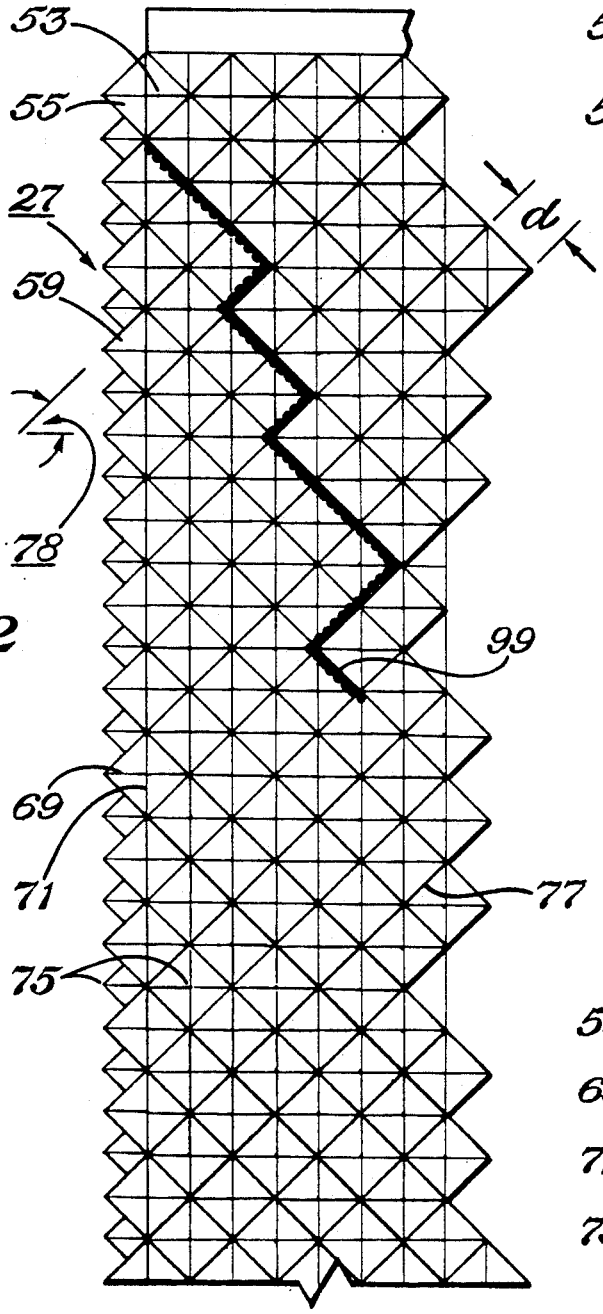
FIG. 2 is a simplified, plan view of the embossed pattern on the rotor of the apparatus of FIG. 1 showing the pattern rolled out as a flat surface.
Figure 4:
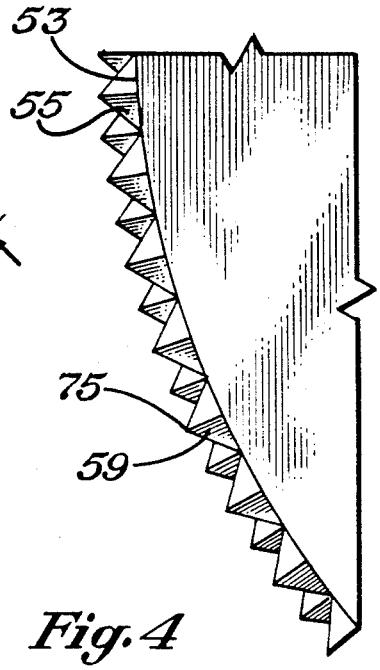
FIG. 4 is a partial, sectional view of the rotor of FIG. 1 taken along lines IV.—IV.
Figure 3:
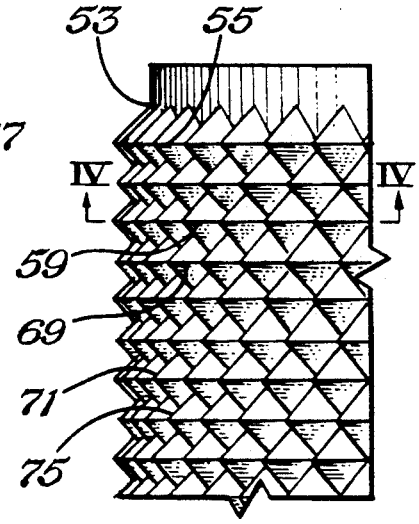
FIG. 3 is an isolated view of a portion of the exterior surface of the embossed rotor of FIG. 1.

As best shown in FIGS. 2-4, the cylindrical drum 27 has an outer surface 53 which is raised or embossed with a repeating pattern of pyramidal shapes 55. Each pyramidal shape 55 is a polyhedron with four triangular lateral faces, 59 which meet at a common vertex or apex 75. The intersection of the lateral faces 59 form four lateral edges 69, 71 of the pyramid. The two face edges 69 between faces 59 are horizontal and perpendicular to the axis of rotation. The two face edges 71 between faces 59 are in vertical planes parallel to the axis of rotation.

Most preferably, each face 59 of the pyramid is an equilateral triangle. Apex 75 protrudes perpendicularly from the drum outer surface 53.

Each face 59 has a base edge 77 that is a groove or junction separating one pyramidal shape 55 from an adjacent pyramidal shape 55. Consequently each pyramidal shape 55 will have four base edges 77, defining the perimeter of each pyramidal shape 55. The base edges 77 of each pyramidal shape 55 intersect each other in 90 degree corners, resulting in a square perimeter for each pyramidal shape 55.

As shown in FIG. 2, the pyramid shapes 55 form a symmetrical 45° pattern or grid about the drum outer surface 53 with adjacent base edges 77 forming grooves about the outer surface. The base edges 77 are each at an angle 78 of 45° with respect to the axis of rotation of drum 27. As a result, adjacent base edges 77 form a helical groove for channelling slurry material about the face of the drum. However, because of the 45° pattern layout of the pyramidal shapes, the actual flow of the slurry about the face of the drum is sinuous. That is, bending, winding or curving in and out. A typical sinuous flow path across the face of the drum is shown as 99 in FIG. 2.

The distance between base edges 77 ("d" in FIG. 2) is preferably on the order of 1/16th inch for a cylindrical drum 8 to 12 inches in diameter and 20 to 48 inches in length. The drum is preferably sized so that the clearance between the apexes 75 of the pyramidal shapes and the interior sidewalls 19 of the housing 13 defines a gap in the range from about 0.050 to 0.075 inches, most preferably about 0.065 inches. The distance from the bottom of each groove to the interior sidewalls 19 is preferably about 0.090 inches for a drum of the dimensions previously recited.

Figure 5:
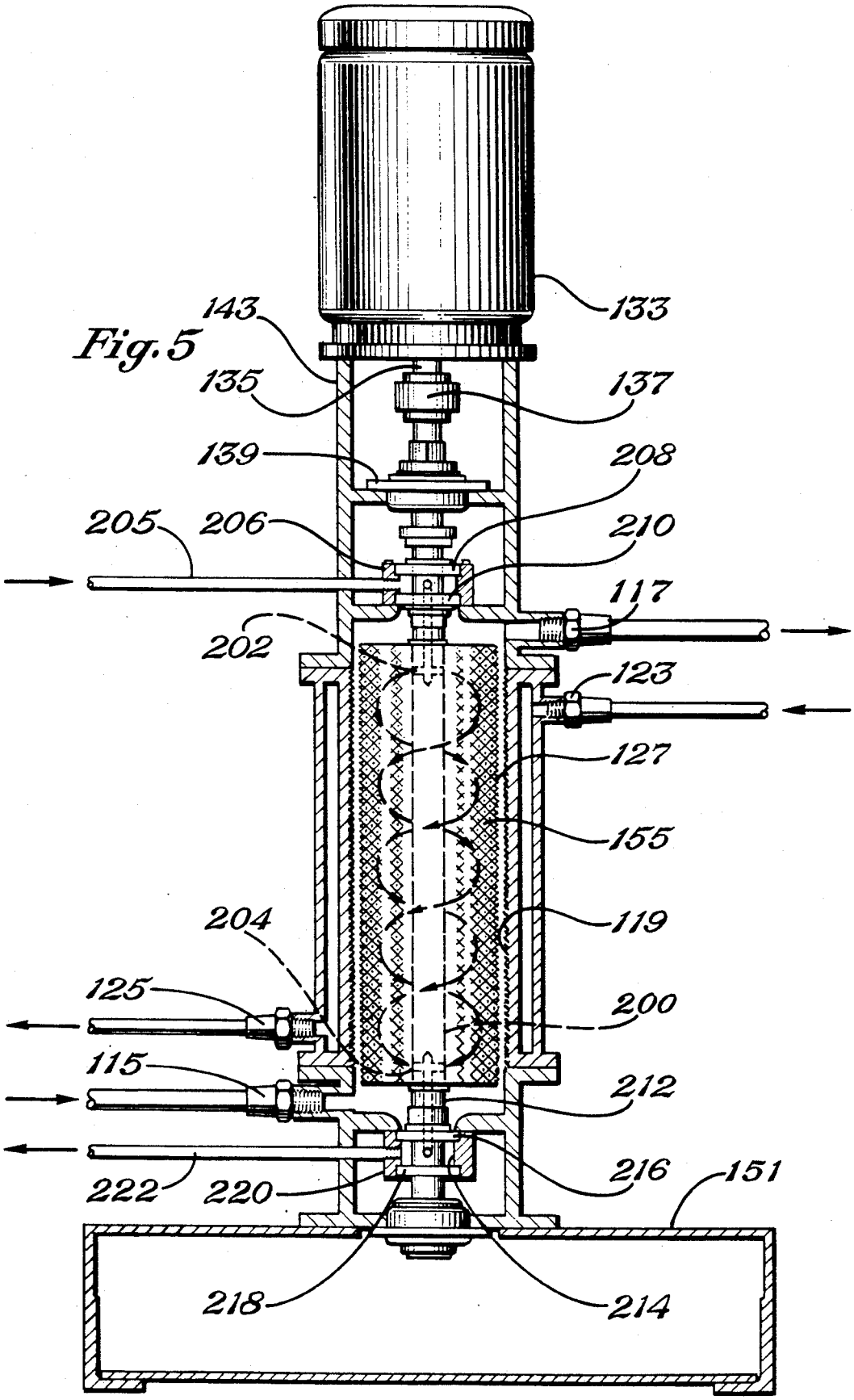
FIG. 5 is a side view, similar to FIG. 1, of another embodiment of the mixing apparatus of the invention showing the coolant/lubricant system.

FIG. 5 shows another embodiment of the invention in which the interior sidewalls 119 preferably have an identical pyramidal pattern to the pyramidal shapes 155 on the drum 127. The gap between the drum 127 and the interior sidewalls will thus be the distance from the apexes (identical to apex 75 in FIG. 2) of the pyramidal shapes on the drum 127 to the apexes of the pyramidal shape on the interior sidewall 119. The elements in FIG. 5 which are common to FIG. 1 have been numbered identically with the exception of the prefix "1."

In the embodiment of the invention shown in FIG. 5, a hollow drum 127 has a solid internal shaft 200 which is drilled and cross-drilled at either end to provide an inlet opening 202 into the drum interior and an outlet opening 204 from the drum interior.

A coolant/lubricant supply conduit 205 communicates with the upper seal housing 206 between a stationary upper seal 208 and rotating lower seal 210. The upper seal 208 is typically a rubber coated ceramic material while the lower seal 210 can have a solid tungsten carbide wear face, as previously discussed with reference to seals 41, 45. In the embodiment of FIG. 5, coolant/lubricant is supplied through inlet opening 202 to the drum interior. The coolant/lubricant can be, e.g., undiluted propylene glycol for providing temperature control (heating or cooling) of the rotor. After passing through the interior of the drum 127, the coolant/lubricant passes into the outlet opening 204 and flows through internal passageway 212 to the annular opening 214 between the upper and lower seals 216, 218 provided in the lower seal housing 220. The lower seal housing 220 has been tapped to receive a conduit 222 for receiving the outgoing coolant/lubricant. The coolant/lubricant would then be recirculated through the supply conduit 206 back to the upper seal housing 206.

An invention has been provided with several advantages. The high speed mixing apparatus of the invention effectively disperses dissimilar materials within a highly viscous slurry to produce a homogeneous product. The apparatus has been especially effective in uniformly dispersing within a resin/solvent carrier metal oxides and other difficult to disperse pigments, such as carbon black, burnt umber and thalo blue. The dispersion is effective even where the dry pigment content was on the order of 40-60% by volume of the slurry. The apparatus operates without the necessity of additional solid or abrasive media such as sand, grit, shot or ceramic balls. As a result, the overall effective life of the apparatus is increased and the cost of operation is reduced.

While the invention has been shown in only one of its forms, it is not thus limited but is susceptible to various changes and modifications without departing from the spirit thereof.

I claim:

1. A high speed mixing apparatus for slurry materials, comprising:

a stationary housing having interior sidewalls, an inlet and an outlet;

a central bore extending through the housing and communicating with the inlet and the outlet;

rotor means having a vertical axis of rotation and mounted with the central bore for rotation with respect to the stationary housing, the rotor means being spaced from the housing interior sidewalls to define a sleeve-like space for the passage of slurry materials between the inlet and outlet, the rotor means having an outer surface which is embossed with a repeating pattern of pyramidal shapes, each pyramidal shape having four identical triangular faces which meet at an apex, the apex protruding perpendicularly from the outer surface;

each face having a horizontal face edge that joins an adjacent face of the same pyramidal shape, each face having a vertical face edge that joins an adjacent face of the same pyramidal shape, the vertical face edges being in planes parallel to the vertical axis of rotation, the horizontal face edges being perpendicular to the vertical axis of rotation;

each face having a base edge that is a junction of a base edge of a face of an adjacent pyramidal shape, each base edge being at an angle of 45 degrees relative to the vertical axis of rotation, the base edges creating grooves in the sleeve-like space for directing the flow of slurry from the inlet to the outlet in directions 45 degrees relative to the axis of rotation to enhance mixing; and propulsion means, coupled to the rotor means, for rotating the rotor means within the central bore.

2. A high speed mixing apparatus for slurry materials, comprising:

a stationary housing having cylindrical interior sidewalls, an inlet and an outlet;

a central bore extending through the housing and communicating with the inlet and the outlet;

a cylindrical drum having a vertical axis of rotation and mounted within the central bore for rotation with respect to the stationary housing, the drum being spaced from the housing interior sidewalls to define a sleeve-like space for the passage of slurry materials between the inlet and outlet, the drum having an outer surface which is embossed with a repeating pattern of pyramidal shapes, each pyramidal shape having four identical equilateral triangular faces which meet at an apex, the apex protruding perpendicularly from the outer surface, each face having a base edge that is a junction of a base edge of a face of an adjacent pyramidal shape, each base edge being at an angle of 45 degrees relative to the vertical axis of the drum, the base edges creating grooves in the sleeve-like space for directing the flow of slurry from the inlet to the outlet in directions 45 degrees relative to the axis of rotation to enhance mixing; and a motor having an output shaft which is coupled to the drum for rotating the drum in a direction of rotation within the central bore.

3. The high speed mixing apparatus of claim 2, wherein the drum extends substantially the full length of the central bore between the inlet and outlet.

4. The high speed mixing apparatus of claim 3, wherein the height of the apexes is limited to define a predetermined gap between the drum and the housing, the gap being in the range from about 0.050 to 0.075 inches.

5. The high speed mixing apparatus of claim 2, further comprising:

an outer jacket surrounding the housing and defining an annular space with respect to the housing exterior, the outer jacket having a coolant inlet and a coolant outlet for circulating coolant through the annular space.

6. The high speed mixing apparatus of claim 5, wherein the motor is selected to produce a drum rotational speed in the range from about 1800 to 3600 r.p.m.

7. The high speed mixing apparatus of claim 2, wherein the cylindrical interior sidewalls of the stationary housing have substantially identical pyramidal shapes to the pyramidal shapes on the drum, with the pyramidal shapes on the sidewalls of the stationary housing having apexes radially aligned with the apexes on the pyramidal shapes of the drum and separated by a gap.

8. A high speed mixing apparatus for slurry materials, comprising:

a stationary housing having cylindrical interior sidewalls, an inlet and an outlet;

a central bore extending through the housing and communicating with the inlet and the outlet;

a cylindrical drum having a vertical axis of rotation and having a hollow interior mounted within the central bore for rotation with respect to the stationary housing, the drum being spaced from the housing interior sidewalls to define a sleeve-like space for the passage of slurry materials between the inlet and outlet, the drum having an outer surface which is embossed with a repeating pattern of pyramidal shapes, each pyramidal shape having four identical triangular faces which meet at an apex, the apex protruding perpendicularly from the outer surface;

each face having a horizontal face edge that joins an adjacent face of the same pyramidal shape, each face having a vertical face edge that joins an adjacent face of the same pyramidal shape, the vertical face edges being in planes parallel to the vertical axis of rotation, the horizontal face edges being perpendicular to the vertical axis of rotation;

each face having a base edge that is a junction of a base edge of a face of an adjacent pyramidal shape, each base edge being at an angle of 45 degrees relative to the vertical axis of rotation, the base edges creating grooves in the sleeve-like space for directing the flow of slurry from the inlet to the outlet in directions 45 degrees relative to the axis of rotation to enhance mixing;

a motor for rotating the drum within the central bore;

wherein the rum is mounted on a drum shaft extending through the drum, the drum shaft having one end portion coupled to the motor and an opposite end portion protruding from an opposite end of the drum, and wherein the drum shaft includes an inlet passageway in one end portion for supplying coolant to the hollow interior of the drum and an outlet passageway in the other end portion for conducting coolant from the hollow interior of the drum to the exterior of the apparatus; and wherein the cylindrical interior sidewalls of the stationary housing have substantially identical pyramidal shapes to the pyramidal shapes on the outer surface of the drum, with the pyramidal shapes on the sidewalls of the stationary housing having apexes radially aligned with the apexes on the pyramidal shapes of the drum and separated by a gap.

9. The high speed mixing apparatus of claim 8, further comprising:

an outer jacket surrounding the housing and defining an annular space with respect to the housing exterior, the outer jacket having a coolant inlet and a coolant outlet for circulating coolant through the annular space.

10. The high speed mixing apparatus of claim 9, wherein the height of the apexes on the drum and on the interior sidewalls of the stationary housing are limited to define a predetermined gap between the drum and housing, the gap being in the range from about 0.050 to 0.075 inches.

* * * * *